US007097780B1

(12) United States Patent
Fujita

(10) Patent No.: US 7,097,780 B1
(45) Date of Patent: Aug. 29, 2006

(54) ALUMINUM COMPOSITE MATERIAL AND METHOD OF PRODUCING THE SAME

(75) Inventor: Makoto Fujita, Anjo (JP)

(73) Assignee: Central Motor Wheel Co., Ltd., Aichi (JP)

( * ) Notice: Subject to any disclaimer, the term of this patent is extended or adjusted under 35 U.S.C. 154(b) by 0 days.

(21) Appl. No.: 11/060,454

(22) Filed: Feb. 17, 2005

(51) Int. Cl.
*C23F 1/36* (2006.01)

(52) U.S. Cl. ..... 216/52; 216/102; 428/687

(58) Field of Classification Search ..... None
See application file for complete search history.

(56) References Cited

U.S. PATENT DOCUMENTS

| | | | | |
|---|---|---|---|---|
| 2,341,293 | A * | 2/1944 | Rives | 384/29 |
| 3,333,579 | A * | 8/1967 | Macklin, Jr. et al. | 123/193.1 |
| 3,433,284 | A * | 3/1969 | Williams et al. | 164/111 |
| 3,723,209 | A * | 3/1973 | Hamada et al. | 216/99 |
| 4,789,607 | A * | 12/1988 | Fujita et al. | 428/653 |
| 4,946,647 | A * | 8/1990 | Rohatgi et al. | 420/528 |
| 4,959,276 | A * | 9/1990 | Hagiwara et al. | 428/614 |
| 5,131,356 | A * | 7/1992 | Sick et al. | 123/193.2 |
| 6,096,143 | A * | 8/2000 | Ruckert et al. | 148/439 |
| 6,821,447 | B1 * | 11/2004 | Storstein et al. | 216/11 |
| 2002/0080558 | A1 * | 6/2002 | Nonaka et al. | 361/502 |

FOREIGN PATENT DOCUMENTS

| | | |
|---|---|---|
| JP | 62-235462 | * 10/1987 |
| JP | 03-024945 | * 2/1991 |
| JP | 2004-197148 | * 7/2004 |

OTHER PUBLICATIONS

Patent Abstracts of Japan for JP58-081948 published on May 17, 1983.
Patent Abstracts of Japan for JP06-240305 published on Aug. 30, 1994.

* cited by examiner

*Primary Examiner*—John J. Zimmerman
(74) *Attorney, Agent, or Firm*—Darby & Darby

(57) ABSTRACT

An aluminum composite material has a surface structure in which a part of lubricative granules projects by 2 μm to 25 μm from the surface of the aluminum alloy base material. The lubricative property of the lubricative granules is utilized sufficiently, and the abrasion of the aluminum alloy base material can be prevented. Further, according to a manufacturing method of the aluminum composite material where the surface of the aluminum alloy base material is eroded with a etching solution, a level of erosion of the aluminum alloy base material can be easily adjusted and a surface structure from which the lubricative granules project can be formed sufficiently.

3 Claims, 9 Drawing Sheets

Fig. 9

Evaluation Results of the Sliding Property Test

| | Weight change (mg) | |
|---|---|---|
| | Composite material test piece | Sliding counter material |
| Aluminum composite material (Using graphite) | -0.20 | 0.00 |
| Processed composite material 10 (Graphite) | -11.00 | +0.50 |
| Aluminum composite material (Activated charcoal) | -0.15 | 0.00 |
| Processed composite material 10' (Activated charcoal) | -9.50 | +0.80 |

ALUMINUM COMPOSITE MATERIAL AND METHOD OF PRODUCING THE SAME

BACKGROUND OF THE INVENTION (1) Field of the Invention

The present invention relates to an aluminum composite material and a method of producing the same; wherein lubricative granules are provided at least on a base material surface of an aluminum alloy base material.

(2) Description of the Background Art

An aluminum alloy has been optimally used in devices including such as automobiles, electric appliances, electronic parts, and precious measurement equipment because of its lightness and malleability. Nevertheless, the application of the aluminum alloy is limited to a sliding portion of structures because of low resistance to abrasion. Accordingly, various composite materials such as graphite and activated charcoal with superior lubricating property have been added to a base surface to promote resistance to abrasion.

A composition in which an activated charcoal and ceramics such as alumina particles and alumina fiber are dispersed in an aluminum alloy material was disclosed in Japanese Laid Open Patent Publication No. S58-81.948. Further, a method of manufacturing the composite material was disclosed in Japanese Laid Open Patent Publication No. H6-240305 in which a compact, which was obtained by dehydration or de-alcoholization after alumina short fiber and graphite were mixed with water or alcohol, and an aluminum alloy were made into a complex.

The aluminum composite material as produced above is generally cut mechanically in accordance with the type of application. By the mechanical processing, the lubricative granules exposed on the surface of the aluminum composite material are grinded off. Accordingly, when such an aluminum composite material is used as a sliding member, the lubricative granules are not exposed on the surface or only a very small amount exists, and accordingly, an initial sliding ability or sliding property at a low surface pressure could not be adequately utilized. Accordingly, the aluminum composite materials disclosed in the above JP58-81948 or JP6-240305 could not utilize a desired sliding property even as a sliding member of a specific structure produced by a simple machinery process.

SUMMARY OF THE INVENTION

According to the invention, an aluminum composite material which can achieve an adequate sliding property as a sliding portion material and a method of manufacturing the material are disclosed.

According to an implementation of the invention, in the aluminum composite material, the lubricative granules are connected at least to the base material surface of the aluminum alloy base material. The aluminum composite material includes the surface structure in which a part of the lubricative granules projects by 2 μm to 25 μm from the aluminum alloy base material. When such an aluminum composite material is used for the sliding portion material, the lubricative granules projecting from the surface of the aluminum composite material contact the sliding counter material, and accordingly, the contact of the aluminum alloy base material to the sliding counter material can be prevented, and specifically, any abrasion of the aluminum alloy base material because of burning can be prevented. Further, in accordance with the surface structure in which the lubricative granules are projected to the surface, in the initial sliding with sliding counter material and the sliding with a low surface pressure, an excellent sliding property can be obtained.

In many cases, such lubricative granules projecting from the aluminum composite material surface are pulverized by friction with the counter material and reduced to powder. Thus, the powder of the lubricative granules are dispersed and exist on the sliding surface against sliding counter material, and accordingly a superior lubricative action can be achieved and the aluminum alloy base material can prevent burning from occurring. In order to perform the lubricative action adequately, the size of the projected portion of the lubricative granules from the surface of the aluminum base material is in a range of 2 μm to 25 μm. If the projected portion of the lubricative granules is smaller than 2 μm, the powder pulverized by friction with the sliding counter material becomes minimized, and accordingly, the sliding counter material might contact the aluminum alloy base material and the occurrence of burning cannot be sufficiently prevented. Further if the projected portion is small, the amount of powder pulverized by the friction is so small that the lubricative action cannot be sufficiently achieved. On the other hand, if the projected portion is bigger than 25 μm, the powder pulverized by the friction with the sliding counter material is large, and the gap between the aluminum composite material and the sliding counter material is widened, and accordingly, impurity such as debris can easily accumulated and the ability to lubricate may be degraded.

According to another implementation of the invention, the projected portion of the lubricative granules projecting from the surface of the aluminum alloy base material is larger than the surface roughness of the aluminum alloy base material, and is in a range of less than 50% of the average particle diameter of the lubricative granules. If the size of the projected portion of the lubricative granules is smaller than the surface roughness of the aluminum alloy base material, the sliding counter material would contact the surface of the aluminum alloy material, and therefore, the aluminum alloy material would be easily burned and lubricating ability of the lubricative granules could not be achieved. Further, if the size of the projected portion is bigger than 50% of the average particle diameter of the granules, the lubricative granules could easily drop off from the surface of the aluminum base material. Accordingly, it is highly possible that the lubricative granules could drop off before being used as a sliding portion material during transportation or installation, and accordingly, the aluminum composite material could not be used to suitably take advantage of its sliding property. Thus, according to the composition, the lubricative granules can adequately utilize the sliding property between the aluminum composite material and the lubricative counter material. The aluminum composite material can have an excellent sliding property.

According to another implementation, the lubricative granules are graphite. Accordingly, an excellent lubricating ability of graphite can be utilized and the aluminum composite material can have an excellent sliding property.

According to still another implementation, the lubricative granules are activated charcoal. Accordingly, an excellent lubricating ability of activated charcoal can be utilized and the aluminum composite material can have an excellent sliding property.

Further, according to another implementation, the method of producing the aluminum composite material includes steps of eroding the surface of the aluminum alloy material with a specific etching solution after mechanically working to form a specific form, and, after eroding, executing a surface finishing process to form a surface structure with lubricative granules projecting 2 μm to 25 μm from the surface of the aluminum alloy base material. In such a surface finishing process, by eroding the aluminum alloy base material on the surface with the specific etching solution without eroding or damaging the lubricative granules, a level of erosion of the aluminum alloy base material can be relatively easily adjusted. Thus, the adequate surface structure of the aluminum composite material can be easily formed with the lubricative granules projecting 2 μm to 25 μm from the surface and dotting substantially evenly thereon. Further, the aluminum composite material formed in accordance with such a manufacturing method can have an excellent sliding property. The etching solution can erode the aluminum alloy material to give a desired surface structure.

According to another implementation, in the manufacturing method, the eroding level of the aluminum alloy base material with the etching solution is bigger than the surface roughness of the aluminum alloy base material and in the range of less than 50% of the average particle diameter of the lubricative granules. The eroding level of the aluminum alloy base material can be relatively easily set within the range by such producing method, and accordingly the surface structure being able to perform the abovementioned excellent sliding property can be adequately and easily formed.

According to another implementation, in the manufacturing method, the etching solution is an aqueous sodium hydroxide solution. According to the manufacturing method, the aluminum alloy base material of the surface can be eroded in a relatively short period without eroding the lubricative granules, and accordingly, the surface structure comprising the projected portion of the lubricative granules can be adequately formed.

BRIEF DESCRIPTION OF THE DRAWINGS

FIG. 9 is a table showing results of a sliding property test for the aluminum composite material and the processed composite material according to an embodiment of the present invention.

DETAINED DESCRIPTION OF THE INVENTION

Figure 1A:
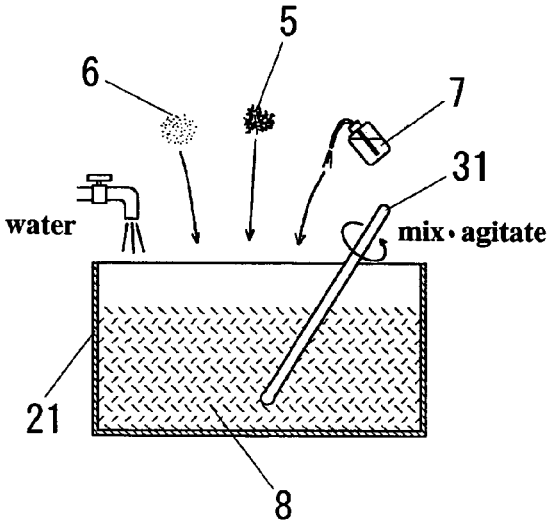
FIGS. 1(*a*)–1(*c*) are figures illustrating a process of pre-forming an aluminum composite material according to an embodiment of the invention.

The inventor explains the embodiments of the present invention referring to the drawings.

Figure 1B:
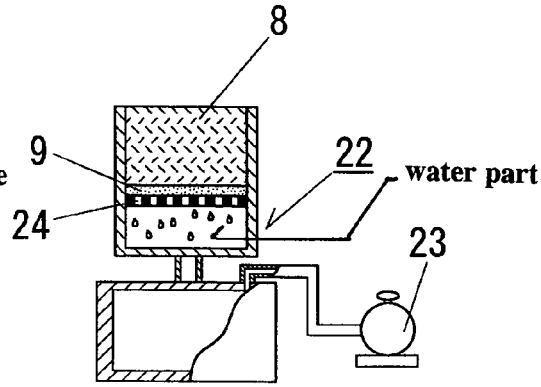
Figure 1C:
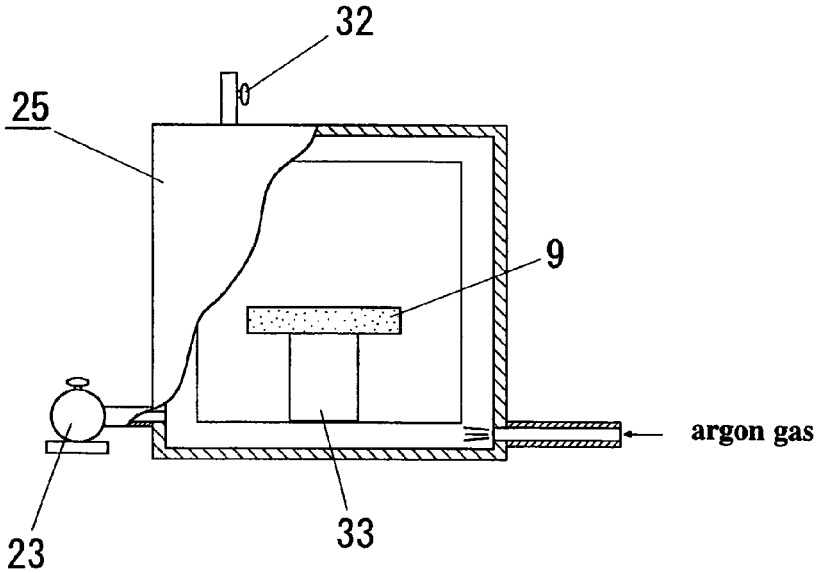
Figure 2A:
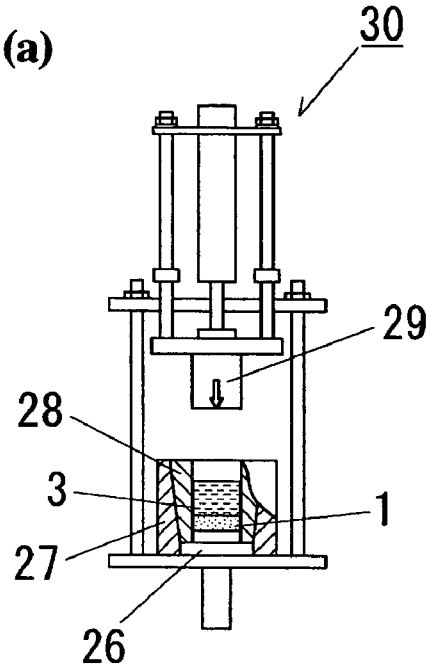
FIGS. 2(*a*)–2(*c*) are figures illustrating a process of eroding aluminum of the aluminum composite material according to an embodiment of the invention.
Figure 2B:
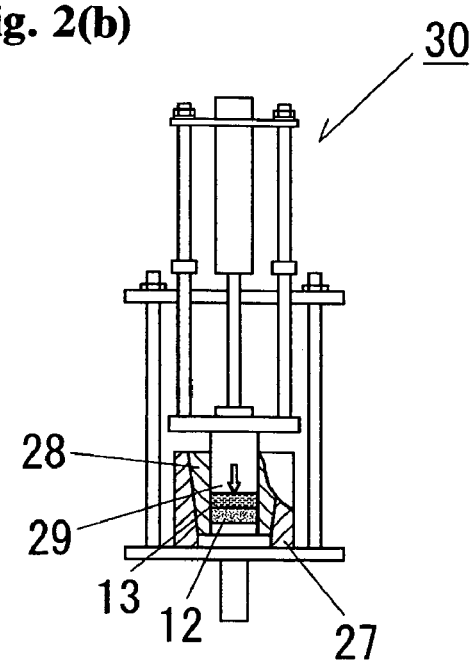
Figure 2C:
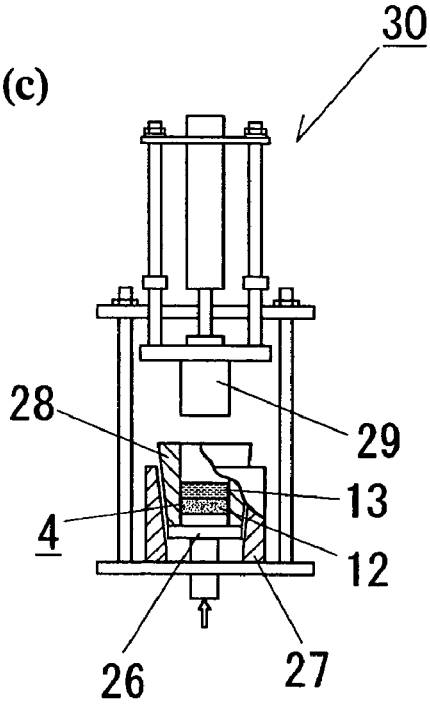
Figure 3:
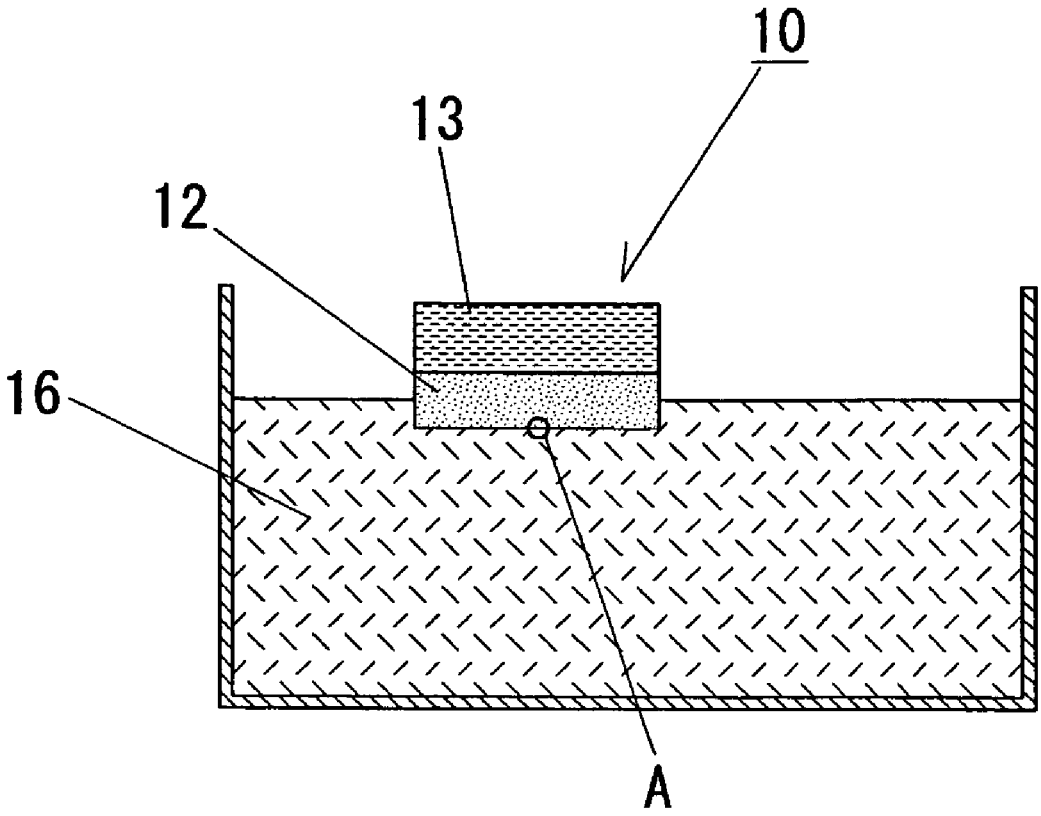
FIG. 3 is a figure illustrating a process of finishing the surface of the aluminum composite material according to an embodiment of the invention.
Figure 4A:
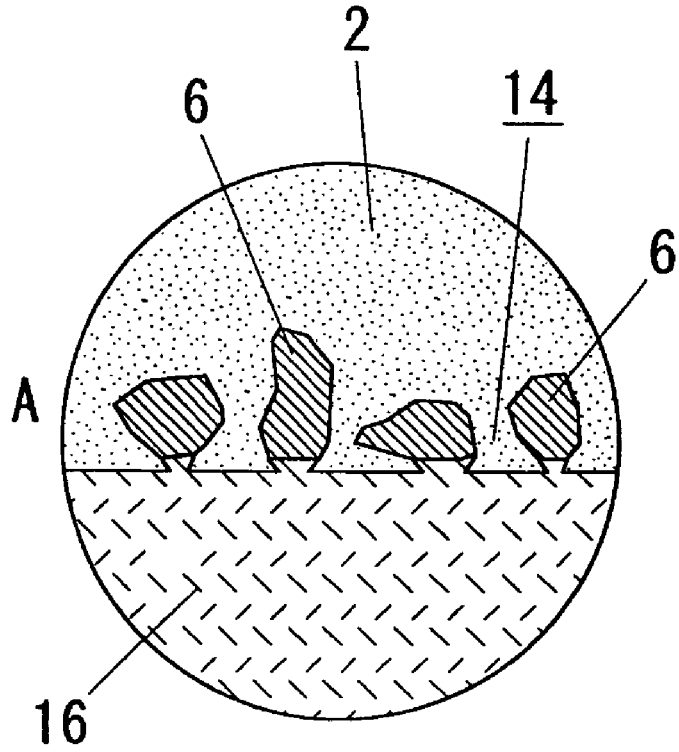
FIGS. 4(*a*)–4(*b*) are figures showing an erosion of the aluminum alloy base material in the surface finishing process and a magnified view at A part of the aluminum composite layer in FIG. 3.
Figure 4B:
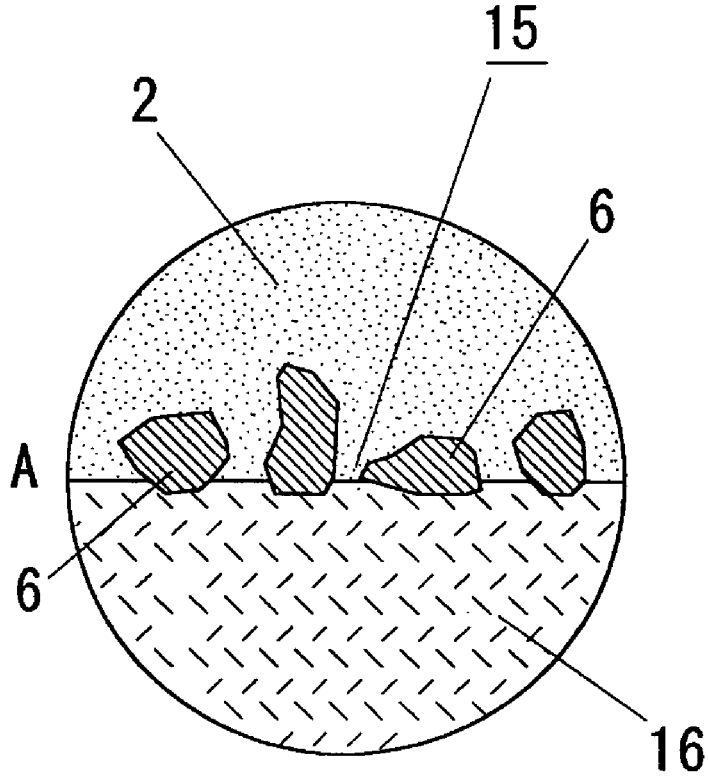

Referring to FIGS. 3 and 4, the aluminum composite material (not shown) according to an embodiment of the invention starts as a pre-form 1 by a pre-form forming process shown in FIG. 1. A hot solution 3 of an aluminum alloy base material 2 is impregnated in the pre-form 1 by the aluminum impregnating process in FIG. 2. A unified form of a composite element 4 of the layering structure body comprises the aluminum composite layer 12 and the aluminum alloy layer 13. Further, after machine-processing to produce a specific form with a milling machine, by eroding the aluminum alloy base material 2 of the surface of the aluminum composite layer 12 with a sodium hydroxide aqueous solution (etching solution) 16, the composite element 4 is produced. In the following, the details of each process are explained.

Referring to FIG. 1 (*a*), an alumina fiber 5 and powdery graphite 6 were mixed by stirring using a rabble arm 31 in water in a specific vessel. Then, alumina-sol 7 as an inorganic binder was added to the aqueous solution in which the alumina fiber 5 and the graphite 6 were being mixed. Wherein, the alumina fiber 5 having approximately 3 μm of the average particle diameter and 50 cc/5 gf of the average length, and a chemical composition of $Al_2O_3$ (approximately 95%)/$SiO_2$ (approximately 5%) was employed, the graphite 6 having approximately 40 μm of particle diameter and chemical composition of C (97%)/$Al_2O_3$ and $SiO_2$ (approximately 3%) were employed. Further, the alumina-sol employed was $Al_2O_3$ (approximately 11%). Further, since the alumina fiber is generally complexly intertwined, the average length was defined quantitatively by volume per unit weight.

And then, the aqueous mixture solution 8 of the alumina fiber 5, the powdery graphite 6 and the alumina-sol 7 were transferred to the suction forming means 22. The suction forming means 22 is connected to the vacuum pump 23, as shown in FIG. 1 (*b*), and draws water of the aqueous solution 8 by the vacuum pump 23 through a filter 24. Accordingly, the dehydrated forming base material 9 in which the graphite 6 was almost evenly dispersed and coagulated on the alumina fiber 5 was obtained. And then, the dehydrated base material was taken out from the vacuum forming means 22 and dried sufficiently (not shown in Fig.).

Referring to FIG. 1 (*c*), the dehydrated forming base material was installed on the table 33 in the heating furnace 25. The inside of the heating furnace 25 was kept under vacuum condition at $1\times10^{-3}$ Torr by the vacuum pump 23. Then, while argon gas at the rate of 5 cc/minute was constantly flown, the furnace was heated up to approximately 1000° C. which was maintained for 2 hours, and then cooled down (not shown in Fig.) to room temperature to give the desired pre-form 1. In addition, during cooling, the argon gas was flown continuously until the temperature was cooled down sufficiently. Further, the argon gas over-flown from the inside of the furnace was exhausted to the outside of the furnace through a leak valve 32. Accordingly, the processes to form the pre-form were carried out step-by-step. Herein, besides argon gas, inactive gas such as helium gas, and reduction gas such as hydrogen gas and nitrogen gas can be employed. Further, the vacuum condition can be employed. In accordance with such atmosphere in the inside of the heating furnace 25, the burning-shrinking (contraction) of the pre-form 1 can be adequately prevented without sintering the graphite 6 or reacting with the alumina fiber 5.

Further, the hot solution 3 of the aluminum alloy base material 2 (JIS AC8A) was impregnated in the pre-form 1 formed in the abovementioned pre-form forming process by pressure-casting. A hydraulic press-machine 30 shown in FIG. 2 was employed for the pressure-casting. A extrusive portion 26 is installed under part of the hydraulic press-machine 30; after casting, by moving the extrusive portion 26 to upper position, a nesting 28 in the inside of a metal mold 27 installed on the extrusive portion 26 can be removed from the metal mold 27. As shown in FIG. 2 (*a*), the nesting 28 was installed in the inside of the metal mold 28 and the pre-form 1 pre-heated by approximately 550° C. was set to the nesting 28. Then the specific amount of the hot solution 3 of the aluminum alloy base material 2 of approximately 750° C. was added to the top portion of the pre-form 1. Then, referring FIG. 2 (*b*), by direct pressing the hot solution 3 from the top direction with a punch 29 of the hydraulic press-machine 30, the aluminum composite layer 12 impregnating the hot solution 3 in the pre-form 1 and the aluminum alloy layer 13 comprising the aluminum alloy base material 2 were produced in the unified form. Then, as shown in FIG. 2 (*c*), the nesting 28 was removed from the metal mold 27 by the extrusive portion 26, and the composite element 4 comprising the aluminum alloy base material 2 and the aluminum composite layer 12 in which the alumina fiber 5 and the graphite 6 were existing as a mixture was obtained. A volumetric content (%) of the graphite 6 in the composite element 4 was 15%, a volumetric content of the alumina fiber 5 was 6.5%. The rest of the volume of aluminum composite layer was the aluminum alloy base material.

Figure 7A:
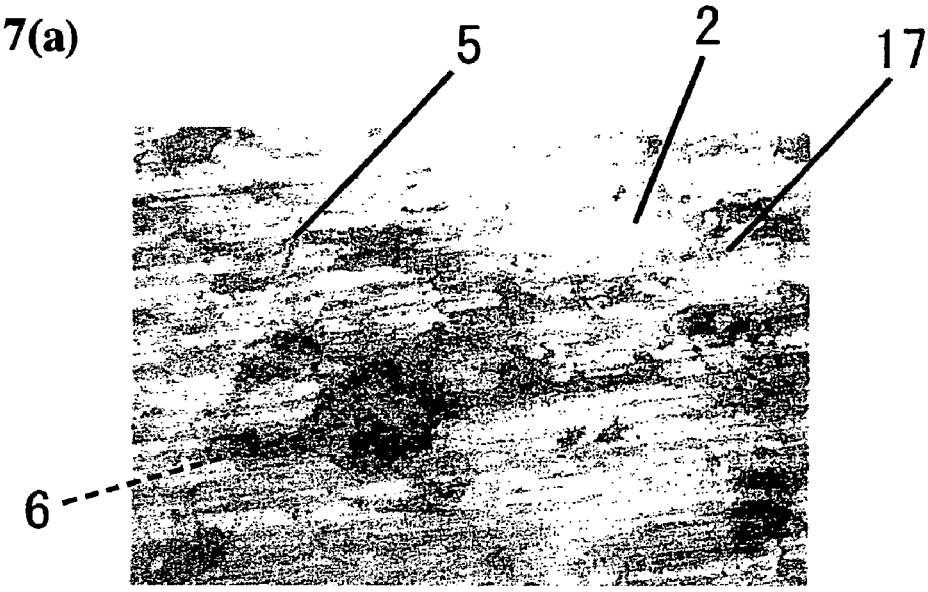
FIGS. 7(*a*)–7(*b*) are figures showing the surface structure of the aluminum composite material according to an embodiment of the invention.
Figure 7B:
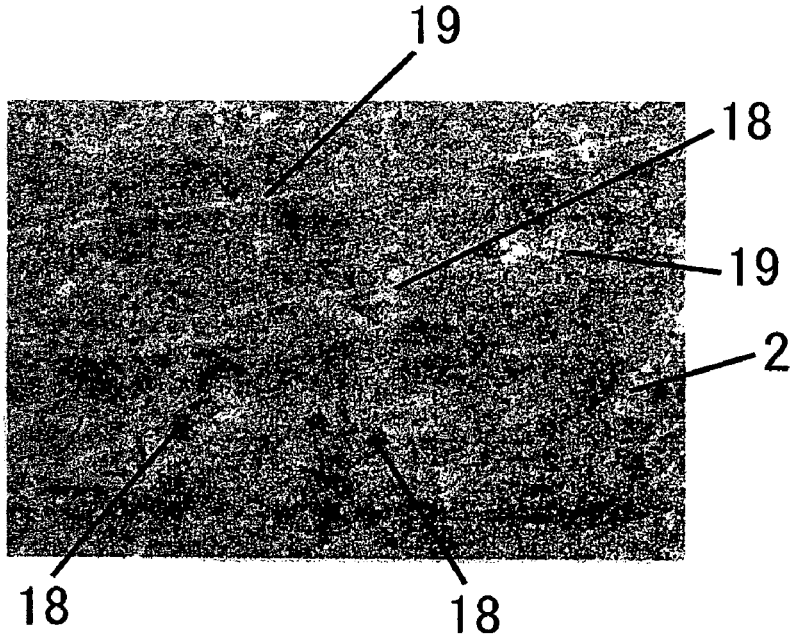
Figure 8A:
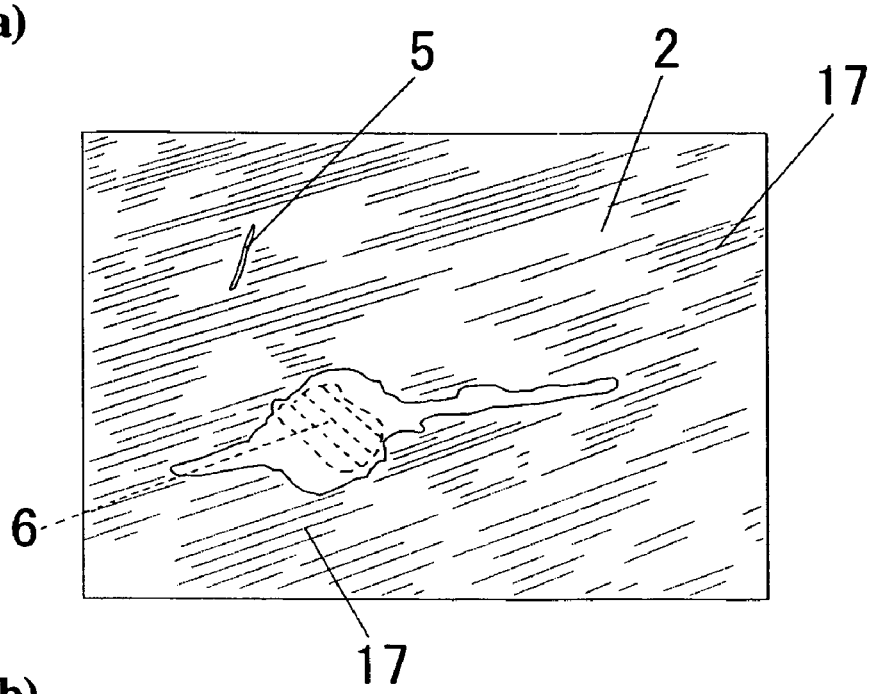
FIGS. 8(*a*)–8(*b*) are schematic drawings of the surface in FIGS. 7(*a*)–7(*b*).
Figure 8B:
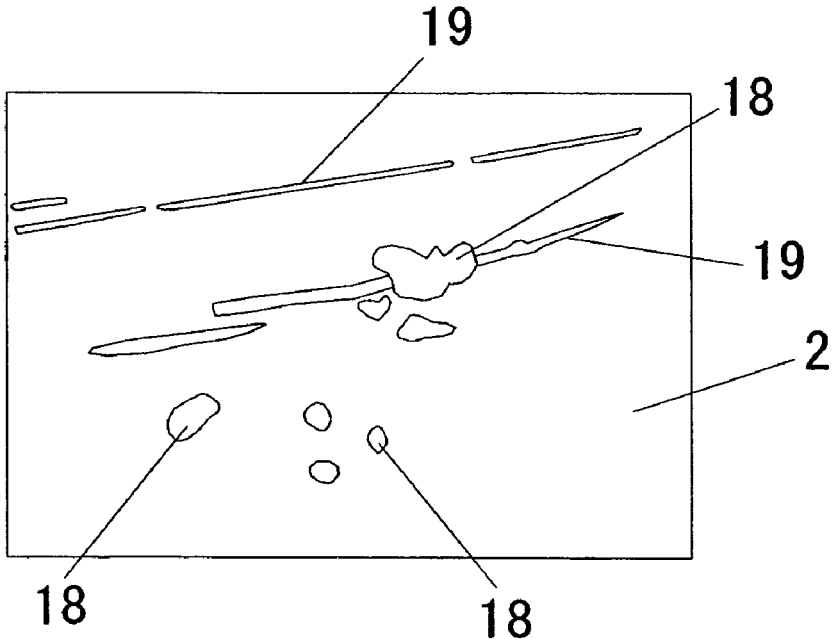

Thus, the formed composite element 4 was machine-processed using a milling machine to provide the processed composite material 10 having a desired sliding portion material. (Not shown in Fig.) Referring to FIG. 7 (*a*) and FIG. 8 (*a*), wherein, the surface structure 14 of the aluminum composite layer 12 composing the processed composite material 10 was formed by the machine-processing.

In the following, the surface finishing process is a principal portion according to an embodiment of the invention. The surface of the aluminum composite layer 12 of the processed composite material 10 was eroded with a sodium hydroxide aqueous solution 16 (an etching solution) as shown in FIG. 3. Referring to FIG. 4 (*a*) to FIG. 4 (*b*), the magnified view at A-part in FIG. 3, the aluminum alloy base material 2 on the surface of the aluminum composite layer 12 was eroded with the sodium hydroxide aqueous solution 16 and a part of the graphite 6 was projected from the surface of the aluminum alloy base material 2. The concentration of the sodium hydroxide aqueous solution 16 was approximately 15% and was stored at approximately 40° C. The erosion time when the sodium hydroxide aqueous solution 16 eroded the surface of the aluminum composite layer 12 was approximately 20 seconds. By such surface finishing process, the aluminum composite material, not shown, comprising the surface structure 15 was obtained; wherein the part of the graphite 6 was projected from the surface of the aluminum alloy base material 2.

Figure 5A:
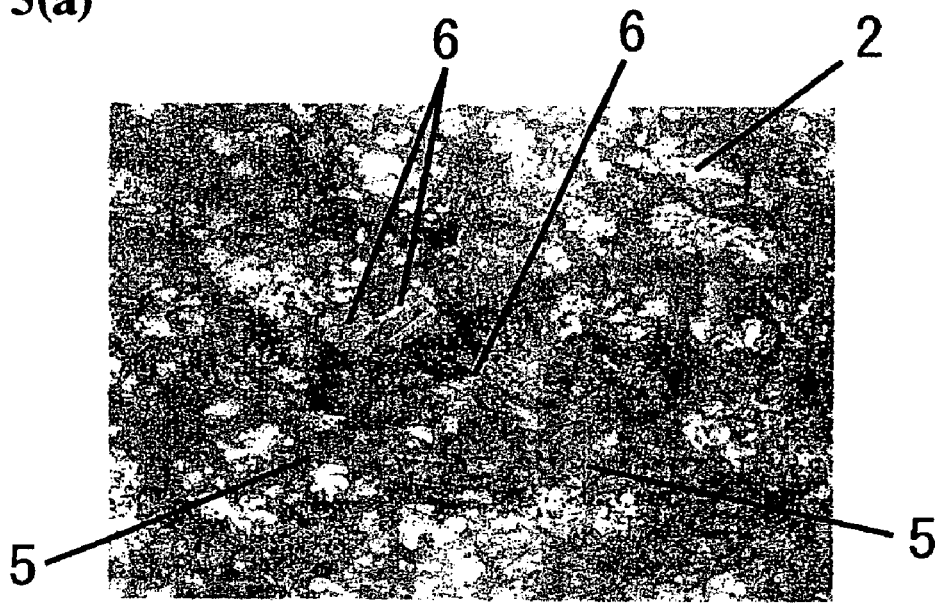
FIGS. 5(*a*)–5(*b*) are figures showing a surface structure of the aluminum composite material according to an embodiment of the invention.
Figure 5B:
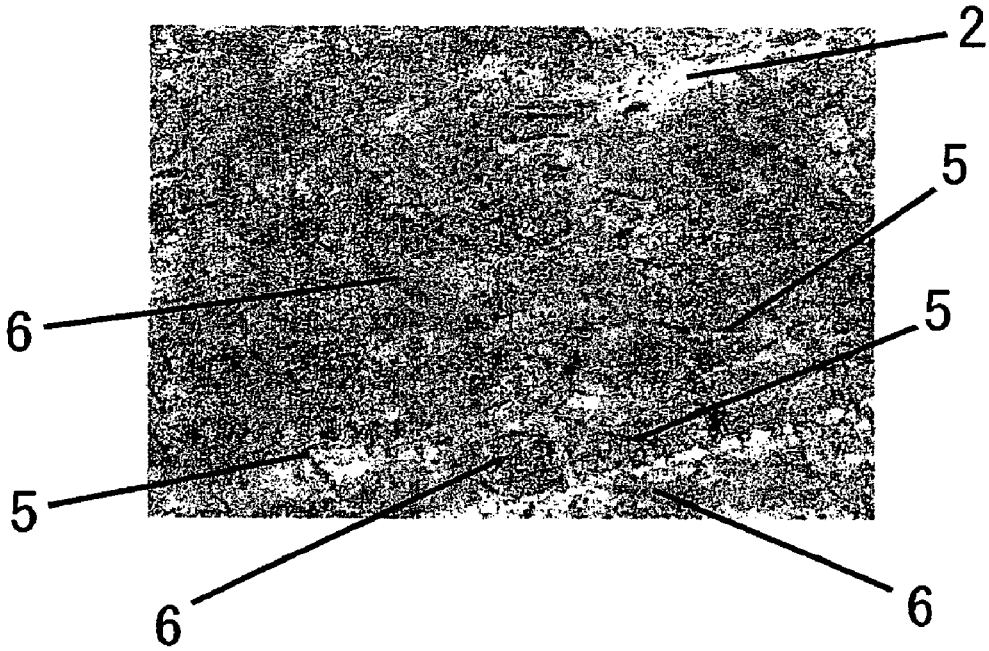
Figure 6A:
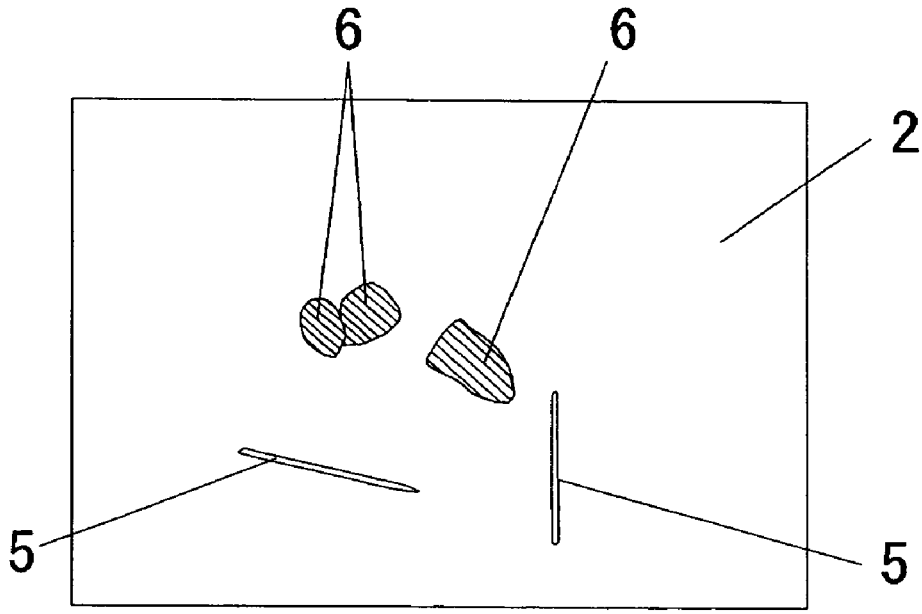
FIGS. 6(*a*)–6(*b*) are schematic drawings of the surface in FIGS. 5(*a*)–5(*b*).
Figure 6B:
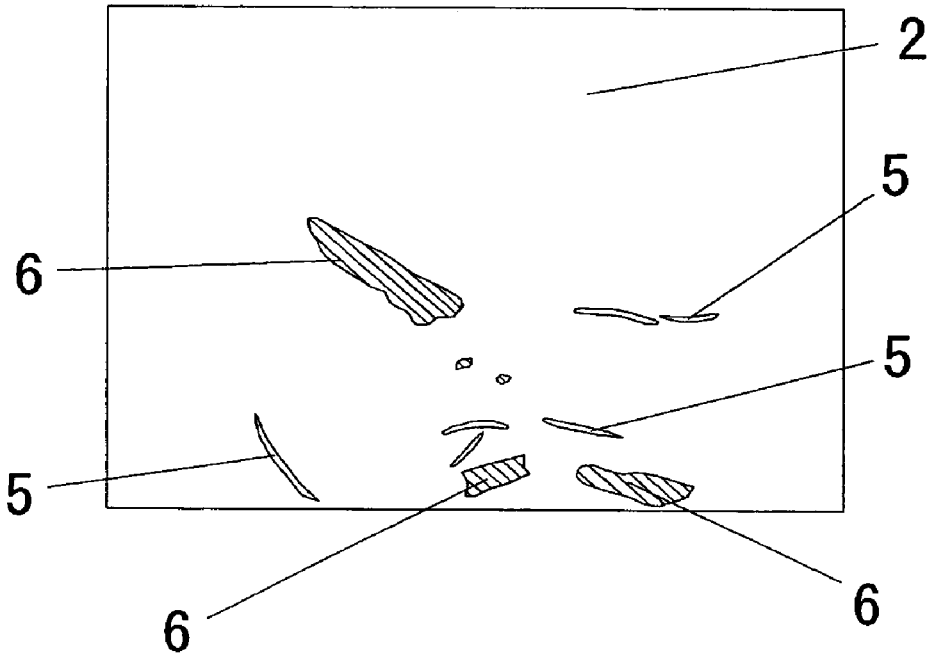

The surface structure 15 of the aluminum composite layer 12 of the aluminum composite material as shown in the surface photo of FIG. 5 (*a*) and the rough sketch of FIG. 6, shows the structure in which the graphite 6 projecting from the surface of the aluminum alloy base material 2. The size of the projected graphite 6 was measured and was approximately 15 μm in average. Further, as comparative example, in the surface structure 14 of the processed composite material 10 as shown in the surface photo of FIG. 7 (*a*) and the rough sketch figure of FIG. 8 (*a*), the graphite 6 which was caved in from the surface of the aluminum alloy base material was confirmed. Further, the cutting damage 17 because of the machine-processing using a milling machine was confirmed in the surface structure of the processed composite material. Specifically, according to the surface structure 14, it was considered that the graphite existing on the surface of the composite element 4 was cut off by machine-processing and accordingly the structure had no graphite 6 exposed on the surface.

The sliding property of the aluminum composite material and the processed composite material 10 was tested by a sliding property test.

In the sliding property test, each specific board shape composite material test piece was set in the motor oil 10W-30 for automobile. Each specific tube-shape chrome steel SCr420 (JIS G 4104) rotating at the rotating rate of 2 m/sec was burdened with surface pressure of 50 MPa to the surface of each aluminum composite layer and when the sliding distance reached to 2400 m, the abrasion property was measured. The abrasion property was obtained by measuring weight change (mg) of the aluminum composite material, the processed composite material, and the sliding counter material.

The results of the above sliding property test are shown in FIG. 9. The weight change of the aluminum composite material was −0.20 mg and there was no weight change for the sliding counter material. In contrast, the weight change of the processed composite material 10 was −11.00 mg and the weight of the sliding counter material increased by 0.50 mg. The weight decrease of the aluminum composite material and the processed composite material 10 were considered due to the burning-on of the aluminum alloy base material 12 and abrasion. Specifically, in case of the aluminum composite material with almost no weight loss, the lubricating action of the graphite 6 projected to the surface was adequately performed. In contrast, the weight loss of the processed composite materials was large, and the lubricating ability of the graphite 6 was not performed. Further, the weight increase of the sliding counter material is considered due to that the aluminum alloy base material 2 burning onto the sliding counter material. Accordingly, from these, the amount of the aluminum alloy base material 2 was obtained, and the excellent sliding property of the aluminum composite material of the invention was understandable.

After the sliding property test, the surface structure of the aluminum composite material 15 and the surface structure 14 of the processed composite material 10 were compared using the surface photos and rough sketches. Referring to FIG. 5 (*b*) and FIG. 6 (*b*), even after sliding property test, the surface of the aluminum composite material surface had no sliding damage or indication of dropout of the graphite 6. Accordingly, it was considered that the projected part on the surface or the pulverized powder performed the lubricative action and burning of the aluminum alloy base material 2 onto the surface was not generated. In contrast, referring to FIG. 7 (*a*) and FIG. 8 (*b*), on the surface of the processed composite material 10, the trace 18 of dropout of the graphite 6 was observed, and relatively large sliding damage 19 was also observed. Accordingly, in the processed composite material 10, it was observed that burning of the aluminum alloy base material 2 onto its surface was generated due to sliding with the sliding counter material. Thus, the aluminum composite material according to the embodiment of the invention has an excellent sliding property in accordance with the graphite 6 and can be optimally applied to various sliding materials.

According to the above embodiment, the aluminum composite material employing the graphite 6 as lubricative granules is disclosed, but also the activated charcoal can be employed. The results of the sliding property test of the aluminum composite material when the activated charcoal was employed are shown also in FIG. 9.

When the aluminum composite material and the processed composite material were compared in case of activated charcoal, the change of the aluminum composite material was −0.15 mg, so that it was extremely small in comparison with −9.50 mg for the processed composite material 10'. As well as the above embodiment using the graphite, even when the activated charcoal was employed as lubricative granules, the aluminum composite material which has an excellent sliding property can be formed. Further, for the aluminum composite material using activated charcoal, the manufacturing method and test method are the same except the activated charcoal employed instead of the graphite 6 as described in the above embodiment and the explanation is omitted. On the other hand, for lubricative granules, others such as molybdenum sulfide and BN can be employed.

In the above surface finishing process, as the erosion condition for the sodium hydroxide aqueous solution 16, in the case of the sodium hydroxide aqueous solution 16 being kept at 40° C., by immersing for 20 to 30 seconds, the aluminum alloy base material 2 on the surface of the processed composite material 10 can be optimally eroded. Further, in the case of the sodium hydroxide aqueous solution 16 being kept at 20° C., the immersing time of 50 to 60 seconds is optimal condition. If an immersing time is longer, the surface of the aluminum alloy base material 2 becomes rough and accordingly the lubricative granules cannot be projected evenly and cannot sufficiently utilize the lubricative ability of the lubricative granules. Further, if the immersing time is short, the aluminum alloy base material on the surface cannot be eroded sufficiently, and accordingly, the lubricative ability of the lubricative granules cannot be utilized.

In the above surface finishing process, the sodium hydroxide aqueous solution was employed as an etching solution, but other such as a hydrofluoric acid solution, a mixed solution of a sodium hydroxide aqueous solution and hydrofluoric acid, and a mixed solution of hydrogen chloride and a hydrofluoric acid solution can be employed with an adequate concentration. According to these, the surface of the aluminum alloy base material 2 can be eroded without eroding the graphite 6. Further, in case of use of such etching solution, conditions such as temperature of aqueous solution, and erosion time should be set up adequately.

In the surface finishing process according to the embodiment of the invention, after forming the pre-form 1, in addition to the composite element 4 produced by including the hot solution 3 of the aluminum alloy base material 2, can be applied to other composite material produced by using various method such as a method for the element produced by adding the lubricative granules directly to the hot solution 3 of the aluminum alloy base material 2.

What is claimed is:

1. A method of manufacturing an aluminum composite material comprising the steps of:

machine processing an aluminum alloy base material into a specific form;

eroding a surface of the aluminum alloy base material with an etching solution;

processing to form surface structure projected parts of lubricative granules of graphite disposed on the aluminum alloy material, projecting by 2 μm to 25 μm from the surface of the aluminum alloy base material; and pulverizing the projected parts of the graphite into powder to cause the powder to act as lubricants on the surface of the aluminum alloy base material.

2. A manufacturing method according to claim 1, wherein erosion of the aluminum alloy base material with the etching solution is larger than the surface roughness of the aluminum alloy base material and in a range of less than 50% of the average particle diameter of said lubricative granules.

3. A manufacturing method according to claim 1, wherein an etching solution is a sodium hydroxide aqueous solution.

* * * * *